United States Patent [19]

Atwater et al.

[11] 4,217,905

[45] Aug. 19, 1980

[54] ATHLETIC BRASSIERE

[75] Inventors: Mark V. Atwater; W. David Atwater, both of Yanceyville, N.C.

[73] Assignee: Royal Textile Mills, Inc., Yanceyville, N.C.

[21] Appl. No.: 17,149

[22] Filed: Mar. 2, 1979

[51] Int. Cl.[2] ..... A41C 3/00

[52] U.S. Cl. ..... 128/498

[58] Field of Search ..... 128/477, 484, 485, 494, 128/498, 500, 510, 517; 2/267, 268

[56] References Cited

U.S. PATENT DOCUMENTS

| | | | |
|---|---|---|---|
| 2,688,748 | 9/1954 | Kahn | 2/267 X |
| 3,220,415 | 11/1965 | Marino | 128/498 |
| 3,606,891 | 9/1971 | Marcario | 128/500 |

*Primary Examiner*—Doris L. Troutman

*Attorney, Agent, or Firm*—Bell, Selzter, Park & Gibson

[57] ABSTRACT

This athletic brassiere provides firm breast support during vigorous activity by the wearer to prevent chafing and tenderness of the breasts, particularly when running, jogging and the like. The brassiere is formed primarily of non-stretchable fabric and includes a pair of two-way stretchable elastic back panels (20, 20') and cooperating stretchable support bands (22,22') which provide for expansion of the chest to permit comfortable breathing of the wearer and free movement of the upper body parts while providing firm support and limiting vertical and lateral movement of the breasts of the wearer. Resilient breast protection pads (P, P') are adapted to be removably positioned in breast supporting cups (C, C') for protecting the breasts from blows or the like.

8 Claims, 7 Drawing Figures

ATHLETIC BRASSIERE

FIELD OF THE INVENTION

This invention relates generally to an athletic brassiere for providing firm breast support during vigorous activity by the wearer and more particularly to an athletic brassiere which is formed primarily of nonstretchable fabric and includes a pair of two-way stretchable elastic back panels and cooperating stretchable support bands to provide for expansion of the chest and permit comfortable breathing of the wearer while providing firm support and limiting vertical and lateral movement of the breasts of the wearer.

BACKGROUND OF THE INVENTION

Many different types of brassieres have been proposed for use by women. Some of these brassieres have been formed primarily of elastic or stretchable fabric, others have been formed primarily of nonstretchable fabric, and others have been formed with a combination of elastic or stretchable fabric and nonstretchable fabric. Generally, those brassieres formed primarily of elastic or stretchable fabric do not provide sufficient firm breast support during vigorous activity by the wearer and those formed primarily of nonstretchable fabric provide firm support but tend to bind the wearer and do not provide sufficient freedom of movement for the wearer during vigorous activity. Brassieres formed of both elastic or stretchable fabric and nonstretchable fabric usually include metal or plastic parts and/or narrow shoulder straps which tend to cause discomfort and abrasion when the wearer takes part in vigorous activity. Presently available brassieres do not provide the type of support and freedom of movement required by women taking part in vigorous athletic activity. For example, it has been found that distance runners, particularly those with larger breasts, develop breast tenderness and in some extreme cases have developed chafed and bleeding nipples because the proper support of the breasts has not been obtained with presently avaiable brassieres.

SUMMARY OF THE INVENTION

With the foregoing in mind, it is an object of the present invention to provide an athletic brassiere which is formed primarily of nonstretchable fabric and includes a pair of two-way stretchable elastic back panels, wide shoulder straps with the rear ends connected to the elastic panels to provide for expansion of the chest and permit comfortable breathing of the wearer and movement of the upper body parts while providing firm support and limiting vertical and lateral movement of the breasts of the wearer during vigorous activities, such as running and the like.

The athletic brassiere of the present invention includes a pair of substantially nonstretchable fabric breast supporting cups joined to each other at the front center of the brassiere along their corresponding inner edges and with integral shoulder strap portions extending divergently upward to provide a substantially V-shaped neckline therebetween. Substantially nonstretchable fabric side panels are connected to the breast supporting cups and extend rearwardly beneath the arms of the wearer and a substantially nonstretchable support band is connected to and extends beneath the breast cups and the nonstretchable side panels.

Two-way stretchable elastic back panels are connected to the opposite ends of the side panels and extend across the back of the wearer and are provided with integral shoulder strap portions extending divergently upwardly from the back panels. Closure tabs are fixed to the outer edges of the elastic rear panels to adjustably connect together and close the brassiere in the middle of the back of the wearer. Relatively wide, nonstretchable fabric shoulder straps are fixed at their forward ends to the integral shoulder strap portions of the breast cups and the rearward ends are fixed to the upper ends of the integral shoulder strap portions of the two-way stretchable elastic back panels.

The two-way stretchable elastic back panels comprise the only stretchable elements or segments of the brassiere and provide for expansion of the chest and permit comfortable breathing of the wearer and movement of the upper body parts while the brassiere provides firm support and limits vertical and lateral movement of the breasts of the wearer during various typs of vigorous activities, such as running, jogging and the like. While the present athletic brassiere is disclosed as being primarily for use by runners and joggers, it is to be understood that this athletic brassiere will be of substantial benefit to women when taking part in other athletic activities, such as tennis, basketball, jumping, baseball, football or other contact sports.

The athletic brassiere of the present invention is also provided with a pair of resilient breast protection pads which generally conform to the configuration of the breast supporting cups and are adapted to be removably positioned in the breast supporting cups for further protecting the breasts of the wearer, particularly when taking part in athletic activities where the breasts may be injured from blows or the like. To this end, the breast supporting cups of the brassiere are provided with inner and outer nonstretchable fabric layers which are stitched together along three sides of each breast supporting cup to provide a pocket with an opening along one side of each breast supporting cup for placement and removal of the breast protection pads. Each of the breast protection pads is formed of resilient foam material and each pad comprises separate upper and lower halves which are seamed together to provide a generally cup-shaped configuration conforming to the configuration of the breast supporting cup and providing a concave inner surface and a convex outer surface.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
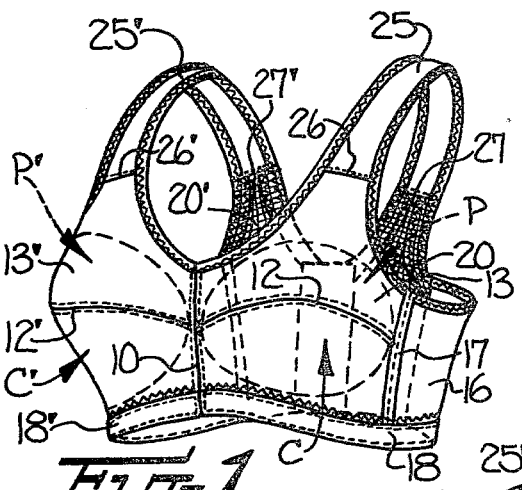
FIG. 1 is a front perspective view of the athletic brassiere of the present invention in substantially the position occupied when being worn.
Figure 2:
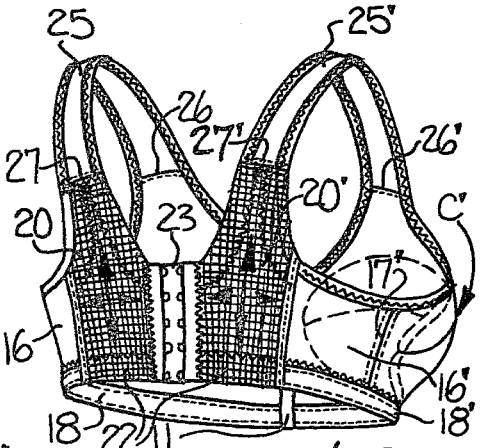
FIG. 2 is a view similar to FIG. 1 but looking at the rear of the athletic brassiere.
Figure 3:
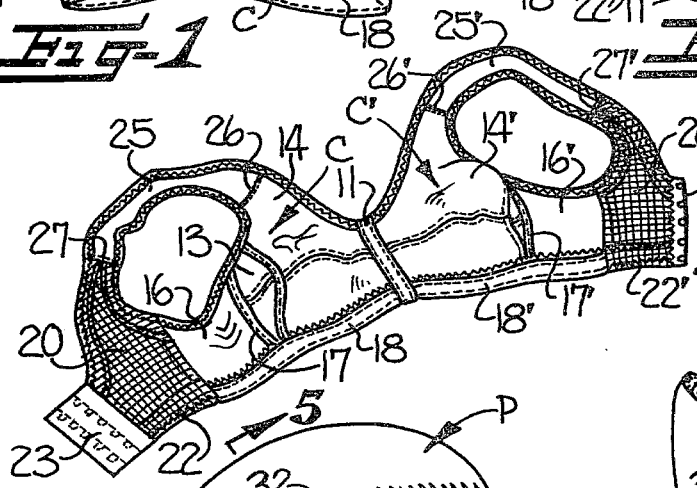
FIG. 3 is an elevational view of the athletic brassiere, showing the inside of the brassiere and in substantially a laid-out or flattened condition.

The athletic brassiere of the present invention includes a pair of substantially nonstretchable fabric breast supporting cups, broadly indicated at C and C'. Since each half of the brassiere is substantially identical, regular reference characters will be applied to the various segments of one half of the brassiere and the corresponding segments of the other half will bear the same reference characters with the prime notation added. The breast supporting cups C and C' each include inner edges joined to each other at the front center of the brassiere, along the line 10 and stitched to a vertical reinforcing strip 11 (FIGS. 3, 6 and 7) in a conventional manner.

The cups C and C' may be of any standard or suitable construction and are generally hemispherical in configuration, usually formed of upper and lower sections and joined together along corresponding horizontal seam lines 12, 12' to provide the desired hemispherical or cup-shaped configuration thereto. The breast supporting cups are formed of inner and outer nonstretchable fabric layers with the corresponding outer layers being indicated at 13, 13' and the corresponding inner layers being indicated at 14, 14'. The outer and inner layers 13, 14 are preferably cut from circular double knit fabric having very little stretch, a smooth, soft hand and substantially the same appearance on each side.

Each of the breast supporting cups C, C' includes substantially horizontal lower edges, substantially vertical outer edges and integral shoulder strap portions extending divergently upward to provide a substantially V-shaped neckline therebetween and to provide outwardly and downwardly curving rear upper edge portions adapted to extend beneath the arms of the wearer. Substantially nonstretchable fabric side panels 16, 16' are provided with substantially vertical inner and outer side edges, a substantially horizontal lower edge aligned with the lower edges of the breast supporting cups C, C', and a downwardly curved upper edge. The inner vertical edges of the side panels 16, 16' are suitably stitched to the vertical side edges of the outer layers 13, 13', as indicated by stitching lines 17, 17'. The side panels 16, 16' are preferably cut from the same type of knit fabric as the outer and inner layers 13, 14 of the breast cups.

A substantially nonstretchable support band, formed of band segments 18, 18', extends beneath the breast cups C, C' and the side panels 16, 16'. The support band includes opposed ends and an upper edge which is fixed to the aligned lower edges of the breast cups C and C' and the side panels 16, 16'.

A pair of two-way stretchable elastic back panels 20, 20' is provided at the rear of the brassiere. Each elastic back panel includes substantially vertical inner and outer side edges, a horizontal lower edge aligned with the lower edge of the nonstretchable support band 18, 18', and an integral shoulder strap portion extending divergently upwardly from the upper portion thereof. The two-way stretchable elastic back panels 20, 20' are preferably cut from a warp knit fabric which is knit with stretchable textured synthetic yarn and stretchable elastomeric or spandex yarn. This knit fabric is commonly known as "power net" and is of open mesh construction to provide ventilation and to provide stretchable support. The elastic back panel is provided with two-way stretch with a greater degree of stretch in the horizontal direction than in the vertical direction.

Longitudinally stretchable support bands 22, 22' extend along and are secured to the inner surface of the lower edge portions of the elastic back panels 20, 20'. The longitudinally stretchable support bands 20, 22 include inner ends aligned with and secured to the opposed ends of the respective nonstretchable bands 18 and 18'. The longitudinally stretchable support bands 22, 22' are preferably in the form of a woven tape with a soft inner surface and stretchable lines of stitching are provided along opposite sides of the support bands 22, 22'.

Closure tabs 23, 23' are fixed to the outer vertical edges of the respective elastic rear panels 20, 20' and are provided with fastening means, illustrated as respective eyelets and hooks, so that the closure tabs may be adjustably connected together to close the brassiere in the middle of the back of the wearer. The closure tabs 23, 23' may be provided with some other suitable type of fastening means, if desired.

A pair of nonstretchable fabric shoulder straps 25, 25' is provided with the forward ends being suitably fixed, as by lines of stitching 26, 26', to the upper ends of the integral shoulder strap portions of the breast cups C and C'. The rearward ends of the shoulder straps 25, 25' are fixed, as by lines of stitching 27, 27', to the upper ends of the integral shoulder strap portions of the elastic back panels 20, 20'. It is preferred that the nonstretchable fabric shoulder straps 25, 25' be relatively wide so that they do not dig into the shoulders of the wearer. The shoulder straps 25, 25' are preferably cut from the same type of knit fabric as the outer and inner layers 13, 14 of the breast cups. It is preferred that the shoulder straps 25, 25' not be widely separated to aid in maintaining the straps in position on the shoulders of the wearer.

Figure 6:
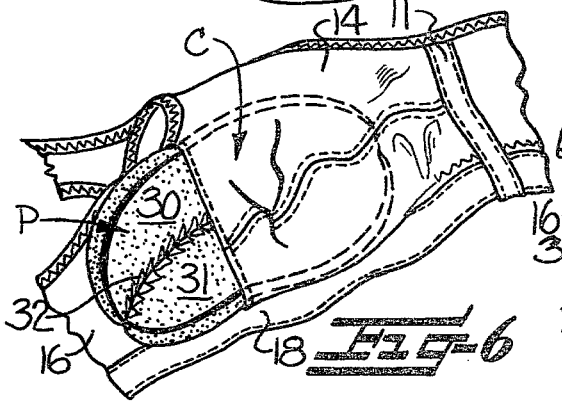
FIG. 6 is a fragmentary elevational view of one breast cup of the brassiere, looking from the inside and illustrating the manner in which the resilient breast protection pad is inserted in the pocket between the inner and outer layers of the breast supporting cup.
Figure 7:
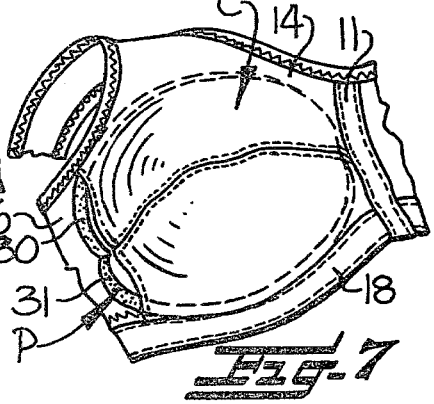
FIG. 7 is a view similar to FIG. 6 but illustrating the resilient breast protection pad positioned within the breast supporting cup.

A pair of resilient breast protecting pads, broadly indicated at P and P', is provided. Each of the pads generally conforms to the configuration of the corresponding breast supporting cup and is adapted to be removably positioned in the pocket formed between the outer and inner layers 13, 14. To this end, the outer and inner nonstretchable fabric layers of each breast supporting cup are fixed together along the horizontal lower edges, the vertical inner edges and the shoulder strap portions while the vertical outer edge of the inner fabric layer 14 is not fixed to the vertical outer edge of the outer fabric layer 13 (FIG. 3) to provide a pocket in each of the breast supporting cups C, C' with an opening for placement and removal of the protective pads therein. FIG. 6 illustrates the protective pad P being moved into position in the breast supporting cup C and through the opening provided between the inner fabric layer 14 and the outer fabric layer 13. FIG. 7 illustrates the resilient breast protection pad P positioned fully in position in the breast supporting cup C.

Figure 4:
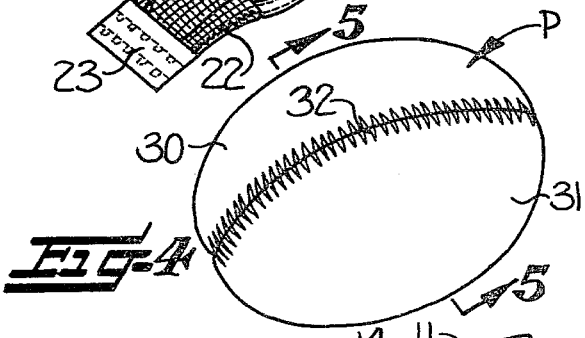
FIG. 4 is a front perspective view of one of the resilient breast protection pads.
Figure 5:
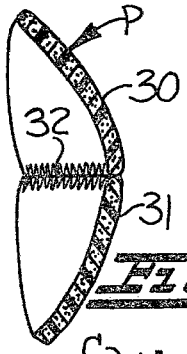
FIG. 5 is a vertical sectional view through the breast protection pad, being taken substantially along the line 5—5 in FIG. 4.

As illustrated in FIGS. 4 and 5, the resilient breast protection pad P is formed with respective upper and lower halves 30, 31 which are cut from sheets of resilient foam material on the order of about $\frac{1}{8}$ to $\frac{1}{4}$ of an inch thick. The foam material is preferably of the type currently manufactured and sold by Uniroyal under the name Ensolite. The adjacent edges of the upper and lower halves 30, 31 are cut along slightly curved lines while the outer edges are cut along substantially elliptical lines. Seam means, in the form of a zigzag seam 32, connects together the corresponding edges of the upper and lower halves of the breast protection pad P so that the inner surface of the pad P is concave and the outer surface is convex (FIG. 5) and the pad P generally conforms to the configuration of the corresponding breast supporting cup C. By providing means for removal and replacement of the pads P in the breast supporting cups C, the pads may be easily removed when it is desired to launder the brassiere. Also, the wearer may elect to wear the athletic brassiere with or without the breast protection pads P, as desired.

The athletic brassiere of the present invention is formed primarily of nonstretchable fabric and the elastic back panels 20, 20' and corresponding stretchable support bands 22, 22' fixed to the lower edge thereof are the sole stretchable segments of the brassiere. The two-way stretch provided in the back panels 20, 20' thus provides some give to the wide shoulder straps 25, 25' and also provides for expansion of the chest to permit comfortable breathing of the wearer and free movement of the upper body parts. At the same time, the elastic back panels 20, 20' provide limited stretchability and firm support to permit very limited vertical and lateral movement of the breasts of the wearer during vigorous activities.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. An athletic brassiere providing firm breast support during vigorous activity by the wearer and comprising (a) a pair of substantially nonstretchable fabric breast supporting cups, including inner edges joined to each other at the front center of the brassiere, substantially horizontal lower edges, substantially vertical outer edges, and shoulder strap portions extending divergently upwardly to provide a substantially V-shaped neckline therebetween, (b) a pair of substantially nonstretchable fabric side panels including substantially vertical inner and outer side edges, substantially horizontal lower edges aligned with said lower edges of said breast supporting cups, and downwardly curved upper edges, said inner vertical edges of said side panels each being fixed to corresponding outer side edges of said breast cups, (c) a substantially nonstretchable support band extending beneath said breast cups and said side panels and including opposed ends, a free lower edge, and an upper edge fixed to said aligned lower edges of said breast cups and said side panels, (d) a pair of two-way stretchable elastic back panels including substantially vertical inner and outer side edges, horizontal lower edges aligned with said free lower edge of said nonstretchable support band, and shoulder strap portions extending divergently upwardly from the upper portions of said back panels, (e) closure tabs fixed to the outer vertical edges of said elastic rear panels and being adapted to be adjustably connected together to close the brassiere in the middle of the back of the wearer, and (f) a pair of nonstretchable fabric shoulder straps including forward ends fixed to said shoulder strap portions of said breast cups and rearward ends fixed to the upper ends of said shoulder strap portions of said elastic back panels, said elastic back panels providing the sole stretchable segments of said brassiere to freely accommodate expansion of the chest and permit comfortable breathing of the wearer and movement of the upper body parts while providing firm support and limiting vertical and lateral movement of the breasts of the wearer during vigorous activities.

2. An athletic brassiere according to claim 1 wherein said shoulder strap portions are integral with said breast supporting cups.

3. An athletic brassiere according to claim 1 wherein said shoulder strap portions are integral with said back panels.

4. An athletic brassiere according to claims 1, 2 or 3 and including a pair of longitudinally stretchable support bands including inner ends aligned with and secured to said opposed ends of said nonstretchable support band, said stretchable support bands extending along and being secured to the inner surface of the lower edge portions of said elastic back panels.

5. An athletic brassiere according to claim 1 wherein each of said breast supporting cups comprises inner and outer nonstretchable fabric layers.

6. An athletic brassiere according to claim 5 including a pair of resilient breast protection pads generally conforming to the configuration of said breast supporting cups and adapted to be removably positioned in said breast supporting cups and between said inner and outer nonstretchable fabric layers.

7. An athletic brassiere according to claim 6 wherein said inner and outer nonstretchable fabric layers of each breast supporting cup are fixed together along said corresponding horizontal lower edges, inner edges, and integral shoulder strap portions, and wherein said vertical outer edges of said inner fabric layers are free of connection to said vertical outer edges of said outer fabric layers to provide a pocket in each of said breast supporting cups with an opening for placement and removal of said protective pads in said pockets.

8. An athletic brassiere according to claims 6 or 7 wherein said resilient breast protection pads each comprise upper and lower halves, and including seam means connecting together said upper and lower halves.

* * * * *